United States Patent [19]

Resnick et al.

[11] 4,311,913

[45] Jan. 19, 1982

[54] X-RAY TUBE CURRENT CONTROL

[75] Inventors: Theodore A. Resnick; Walter A. Dupuis, both of Cleveland Heights, Ohio

[73] Assignee: Picker Corporation, Cleveland, Ohio

[21] Appl. No.: 81,674

[22] Filed: Oct. 4, 1979

[51] Int. Cl.[3] ..... H05G 1/30

[52] U.S. Cl. ..... 250/409; 250/402; 250/413

[58] Field of Search ..... 250/408, 409, 401, 402, 250/413

[56] References Cited

U.S. PATENT DOCUMENTS 3,974,387 8/1976 Bronner ..... 250/409

4,072,865 2/1978 Craig ..... 250/409

*Primary Examiner*—Craig E. Church

*Attorney, Agent, or Firm*—Watts, Hoffmann, Fisher & Heinke Co.

[57] ABSTRACT

A closed loop feedback system for controlling the current output of an x-ray tube. The system has circuitry for improving the transient response and stability of the x-ray tube current over a substantial nonlinear portion of the tube current production characteristic.

The system includes a reference generator for applying adjustable step function reference signals representing desired tube currents. The system also includes means for instantaneous sensing of actual tube current. An error detector compares the value of actual and reference tube current and produces an error signal as a function of their difference. The system feedback loop includes amplification circuitry for controlling x-ray tube filament DC voltage to regulate tube current as a function of the error signal value.

The system also includes compensation circuitry, between the reference generator and the amplification circuitry, to vary the loop gain of the feedback control system as a function of the reference magnitude.

2 Claims, 3 Drawing Figures

X-RAY TUBE CURRENT CONTROL

BACKGROUND OF THE INVENTION

1. Field of the Invention

This invention relates to the field of x-ray medical diagnostics, and more particularly to improving the transient response and stability in the control of diagnostic x-ray tube output in systems such as computerized tomographic equipment.

2. Description of The Prior Art

In use, a medical diagnostic x-ray tube is electrically actuated to produce x-rays which are directed through a patient's body. A pattern of x-rays which pass through the patient's body is sensed and the information obtained is used to produce a representation, most often a visual image, of internal body structure.

A typical x-ray tube includes a thermionic filament, or cathode, and an anode, both located within a substantially evacuated glass envelope. An electrical potential is applied across the filament. The resultant heating of the filament causes the filament material to emit, or "boil off", electrons, creating an electron cloud around the filament. A high potential is applied between the filament and an anode to accelerate electrons from the cloud so that they strike a target area of the anode and x-ray energy is emitted.

The flow of electrons from the cathode to the anode is known as the "anode current" or the "tube current", as distinguished from "filament current" which is the flow of electrons through the filament to effect its heating.

The rate of x-ray energy production is an increasing function of the tube current, other parameters being equal. For a fixed cathode to anode potential, tube current is an increasing function of the density of the electron cloud which in turn is a function of the potential applied across the filament. There is, therefore, a relationship between tube current and filament voltage. Typically the relation is exponential, i.e. nonlinear. Thus, the change in tube current which results from a given change in filament voltage is greater at higher filament voltages, i.e. higher tube currents, than for the same change at lower tube currents and filament voltages.

The life of an x-ray tube is a decreasing function of the output level at which it is operated, i.e. the intensity of x-ray energy it is stimulated to produce. Tube operating life is shorter at higher energy output levels than at lower operating levels.

Since the x-ray output is a function of the tube current, and tube current a function of filament voltage, it has been proposed to regulate x-ray output by controlling the tube current by regulating the filament voltage.

X-ray energy control is desirable because it enables optimum selection of a tradeoff in the tube current value selection wherein sufficient x-ray dosage is administered to achieve good imaging of the patient's internal body structure, while limiting the tube current and x-ray output sufficiently to enhance x-ray tube life.

In medical x-ray, the precision of tube current regulation required is a function of the type of study. In radiography, a relatively short, high intensity pulse of x-ray energy is directed through a patient's body, and a piece of x-ray sensitive film is exposed to create a "radiograph". In fluoroscopy, continuously pulsed or constant lower intensity x-ray energy is directed through the patient's body, from which it emerges to fall upon the input face of an image intensifier tube. The image intensifier tube converts the emergent x-ray pattern to a visible image at an output face which can be photographed, or viewed, as with television to observe changes within the patient's body.

In computerized tomography, (CT) a movable x-ray source is provided, along with an array of x-ray detectors. The x-ray source is moved about the patient's body and the x-rays from the source are directed through the body to the multiple detectors. Data processing equipment receives time varying signals describing information from the individual detectors and processes them to produce or "reconstruct" a tomographic image illustrating a planar segment taken through the patient's body.

In computerized tomography, the image is not reproduced directly in analog form as in the case of radiography and flouroscopy. Rather, the image is generated in response to complex time variations in electrical signals produced by each individual detector of the array.

In these radiographic and fluoroscopic systems the precision required in tube current control is not as great as in CT systems, in part because total doses are relatively low, and good imaging can be done over a relatively wide range of dose. More importantly, the x-ray film or fluoroscope time integrates all the energy falling upon it, and is not as sensitive to time variations in energy, but only to its total. In many radiographic devices, alternating current (AC) is used to heat the x-ray tube filament. The AC ripple appearing in filament voltage, and therefore in tube current, is not as significant in radiography, except in very short exposures, where ripple variation is not integrated on film, and in instances where the ripple causes large undesirable tube voltage changes. Also, the transient response of AC filament control is generally faster than for direct current (DC) control, due to required heavy filtering of transformer coupled filament drive circuitry used in A.C. application.

In CT scanning, the degree of precision required in x-ray output control is much greater than in radiography or fluoroscopy. This extreme precision in x-ray output stability is required because the time variations in detector outputs produced in response to detected radiation is crucial in enabling the computerized reconstruction of a quality image.

One means of enhancing precision control of x-ray output in CT is the use of direct current (DC) to heat the tube. DC is needed because the CT detectors would interpret AC ripple in detected x-rays as representing information about the patient's body.

Two general types of computerized tomographic scanners are the "translate-rotate" type (TR) and the "stationary detector" type (SD). In the TR type, the x-ray source is moved relatively slowly. In the SD type, in which an orbiting source is used in conjunction with a 360° ring of stationary detectors positioned about the patient, the x-ray tube may move rapidly about a curved path around the patient's body.

The exercise of control for minimization of tube operating time is much more important in SD machines than in TR machines. In TR scanning, a stationary anode tube is used, and an oil bath is applied directly to the anode to cool it in order to counteract the effects of heating which results when the tube is driven at, e.g., about 6 kilowatts for scans requiring about 16–18 seconds. By dissipating the heat from the anode in the oil bath, the stationary anode tube can operate for relatively long periods at these fairly high output levels without unduly shortening its life. Moreover, the tube produces x-rays during each rotate portion of a scan so there is opportunity for cooling the anode when it is not producing x-rays.

A TR scanner also facilitates precise and periodic calibration of x-ray tube ouput. One can employ adjustment circuitry which can be operated to precisely calibrate the tube output and allow the tube to settle to a stable operating outputbefore actual data collection begins.

In the stationary detector machine, the need for even higher driving power (e.g. 28 kilowatts) makes a rotating anode type x-ray tube necessary and renders impractical the use of direct cooling of the anode by an oil bath.

Expressed another way, a stationary anode cannot be used (compared to radiographic work) at SD high power relatively long term loadings because its focal spot would overheat. Consequently, a rotating anode tube is used, because the rotating anode distributes the electron stream and the heat over a large anode section. It is not practical to directly oil cool a rotating anode, and therefore such a tube is more vulnerable to destructive heat buildup than the stationary anode variety having direct anode oil cooling.

In the stationary detector apparatus, it is therefore desirable to limit tube operating time to an absolute minimum so that life of the less efficiently cooled tube is not shortened more than necessary by heating. Consequently, the time allowed for calibrating the tube should be as short as possible, so that tube operation time is not extended any more than necessary outside the time of actual x-ray scanning duty in which data is collected. Nevertheless, the requirements of computerized tomography still demand that, during the actual scanning time, the tube output be as uniform and precisely controlled as possible. While the rise time of tube output should be as short as possible, overshoot in tube operating level from the steady state desired value should be minimal. To express this another way, the transient response of the x-ray tube output, upon actuation of the tube, should be approximately critically damped, the output rising in a smooth and rapid progression to the steady state level specified by the tube input parameters, there being minimal overshoot and subsequent oscillation of the tube output about the predetermined steady state value.

The problem of obtaining fast rise time in CT is aggravated by the need, as described above, for using DC filament current. The DC is inherently slower in control response than is the AC used in radiography.

Since the current output of many x-ray tubes is nonlinear with respect to the controlling filament voltage, the transient response of the x-ray tube output current varies, dependent upon the steady state output current toward which the tube is driven upon actuation. This difference in transient response dictates that, in order for the transient response to be substantially uniform for various steady state currents selected, compensation must be performed with respect to the electrical circuitry actuating the tube, in order to insure that the transient rise to each selected steady state value be critically damped, neither suffering from the slow response of overdamped conditions, nor from the overshoot or instability associated with underdamping.

In practice, it has been found that it is desirable to be able to bring the tube operating level up to the steady state reference value within approximately 200 milliseconds (ms).

It is therefore an object of this invention to provide circuitry for controlling the tube current output of an x-ray tube to raise tube current to a predetermined desired steady state level, selected from a broad range of current values, in as short a time as possible consistant with the maintenance of stability in the output current, notwithstanding nonlinearity of the x-ray tube current output with respect to changes in filament voltage.

SUMMARY OF THE INVENTION

The foregoing disadvantages of the prior art are overcome, and the expressed needs in connection therewith are met, by the control system of this invention which includes closed loop feedback circuitry for governing the output current of an x-ray tube by control of its filament voltage, wherein the transient response of the tube is maintained substantially uniform and rapid, while maintaining stability, over an extensive range of selected steady state current outputs despite the nonlinearity of the x-ray tube current response.

The control circuitry of this invention is suitably embodied in a computerized tomographic system having an x-ray source including an x-ray tube which is movable along a path about the body of a patient. An array of detectors is provided about the patient's body and to intercept x-rays from the source after they have passed through the body. Data processing circuitry is coupled to the individual detector elements, for processing x-ray responsive signals from the detectors to provide on a display apparatus a cross-sectional image of a planar section taken through the patient's body.

A closed loop feedback circuit is provided for controlling the output current of the x-ray tube. The circuit includes a generator for producing an adjustable step function reference signal which represents a predetermined desired steady state value of x-ray tube output current. A sensor is included for detecting the instantaneous actual tube current output. A detector circuit compares the actual sensed current with the reference signal and produces an error signal which is a function of the difference therebetween.

Feedback loop circuitry including certain amplification circuitry governs the x-ray tube filament voltage as a function of the error signal to cause the x-ray tube current to rise toward the predetermined steady state value, and, once attaining the value, to remain constant. Special gain adjustment circuitry is coupled between the amplification circuitry and the reference generator. The gain adjustment circuitry serves to alter the gain of the amplification circuitry as a decreasing function of value of the reference signal.

This control circuit improves and renders relatively uniform and critically damped the transient response of the x-ray tube to a step input representing any of a range of several steady state output currents. The maintenance of this substantially uniform, and approximately critically damped transient response enables a rapid and uniform settling time of the output current to whatever its selected steady state value may be, while at the same time minimizing undesirable overshoot and subsequent oscillation of current output value about its predetermined steady state value. All this is accomplished, notwithstanding the fact that the x-ray tube current output is a nonlinear characteristic with respect to the input filament voltage increments which control the output current.

More specifically, when relatively low steady state output currents are selected, and the tube is operating on a lower slope portion of its characteristic output current curve, the gain of the feedback control loop is maintained at a relatively high level, in order to minimize the output current rise time, which is desirable to bring the tube rapidly to steady state operating condition. When, however, a higher steady state value is selected and tube operation moves to a higher sloped portion of its exponential characteristic curve, the need for high gain amplification decreases, and the primary problem becomes that of preventing overshoot and possible instability in tube operation, due to the greater sensitivity of the tube output current with respect to changes in the filament voltage. At these higher levels, the gain adjustment circuitry operates to reduce the gain of the amplification feedback loop circuitry so that unstable or oscillatory transient response is prevented, while still not reducing the gain so much as to slow down the transient rise time to an undesirable extent.

In a more specific aspect of the invention, the reference generator includes circuitry for producing a reference signal in digital form, along with a digital to analog converter for presenting the reference signal in analog form to the error signal detector.

Another specific aspect of the invention involves the tube current sensing circuitry including a resistive impedance interposed in the output current circuit of the x-ray tube.

The amplification circuitry, in a more specific aspect, includes an operational amplifier having a feedback loop, the impedance of that loop controlling the gain of the operational amp. Several impedance elements are provided, each one being independently connectable in the feedback loop so that the gain of the amplifier may be changed according to which of the impedance elements is connected in its feedback loop. In this specific embodiment, a digitally responsive switch is coupled between the various impedance elements associated with the operational amplifier and the digital output of the reference generator. The impedance elements coupled in the operational amplifier feedback loop are thus determined by the value of the digital reference signal produced by the reference generator.

In this fashion, the amplification of the circuitry can be decreased in stepwise fashion as a function of increasing values of the digital reference signal. This feature provides for gain adjustment which is fast, and positive, and which approximates the desired gain variations, while employing relatively simple and inexpensive circuit means.

In accordance with another specific feature, the gain adjust circuitry is provided for decreasing the gain of the amplification circuitry of the feedback loop as approximately an inverse function of the reference signal steady state values selected.

According to a more specific feature of the invention, the feedback loop circuitry responsive to the error signal for controlling filament voltage includes a square wave generator for producing a square wave whose amplitude is a function of the magnitude of the error signal. Transformer circuitry is coupled between the square wave generator and the x-ray tube filament, in order to transmit the signal from the square wave generator for adjusting the x-ray tube filament voltage as a function of the square wave amplitude.

These and other features and advantages of the present invention will be observed in more detail with reference to the following description of the preferred embodiment, and to the drawings, in which:

DESCRIPTION OF THE PREFERRED EMBODIMENT

Figure 1:
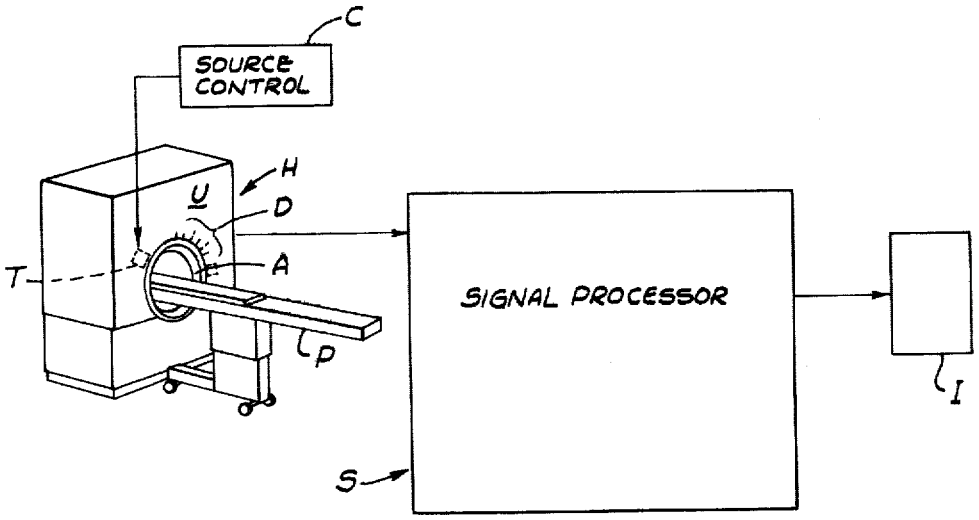
FIG. 1 is a partially graphical, partially block form drawing illustrating a system incorporating the present invention.

A computerized tomographic system S suitably incorporating the invention of this application is illustrated in FIG. 1. The system S includes a scanning unit U for directing x-rays through a patient in accordance with a predetermined operating sequence, and detecting x-ray energy emerging from the patient's body. The scanning unit U produces electrical signals representing the detected x-rays. The electrical signals are transmitted to a signal processing unit X, which processes the electrical signals and actuates an imaging device I to produce a reconstructed visual image representing a planar section taken through the patient's body. A computerized tomographic system such as disclosed in FIG. 1 is described and illustrated in U.S. Pat. application Ser. No. 917,068, filed June 19, 1978 by Zupancic for Computed Tomography Method and Apparatus and assigned to the assignee of this application, which document hereby is expressly incorporated by reference.

The scanning unit U includes a housing H defining circular aperture A therethrough which is of sufficient diameter to accomodate a patient's body supported on a movable patient support structure P. An x-ray source, including an x-ray tube T, is supported within the housing H for orbital movement along a circular path concentric with the aperture A. An array of x-ray detectors D, such as photomultiplier tubes, is arranged in a stationary ring within the housing H, also concentric with the aperture A. The outputs of each of the photomultiplier tube detectors D are individually coupled to the signal processing circuitry X so that variations in the individual detector outputs can be processed to enable the described imaging.

Source control circuitry C is electrically coupled to the x-ray tube T for actuating the tube to produce x-rays while moving along its orbital path. The source control circuitry precisely controls the output current of the tube T, to control x-ray output, and prevents undesirable oscillations and overshoot of x-ray tube output during startup of the tube operation, during which time the tube output is driven to rise very quickly to a predetermined desired steady state value.

Figure 2:
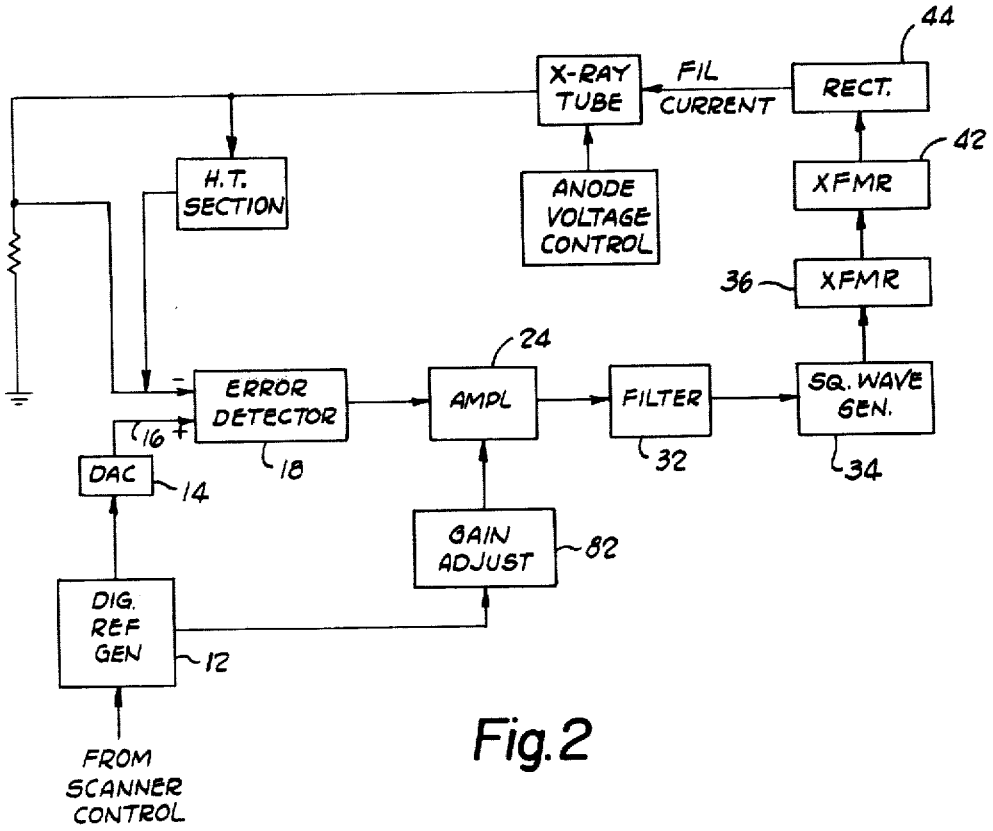
FIG. 2 is a more detailed block diagram illustrating a portion of the system shown in FIG. 1.
Figure 3:
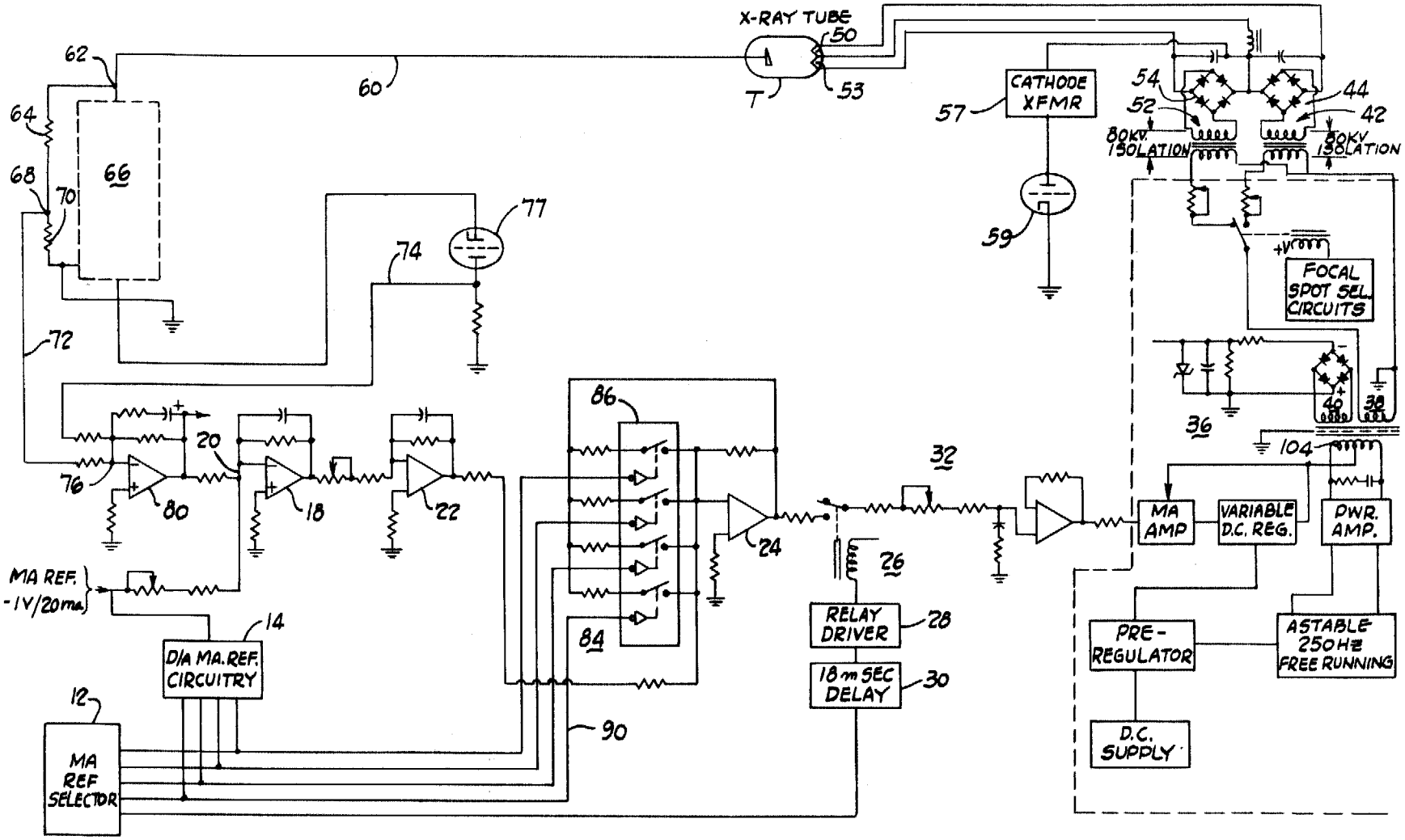
FIG. 3 is a schematic drawing illustrating in detail a portion of the system illustrated in block form in FIG. 2.

The particulars of the source control circuitry C are illustrated in FIGS. 2 and 3. FIG. 2 shows the source control circuitry in block form, while FIG. 3 is a schematic diagram illustrating the corresponding elements of FIG. 2 in more detail. FIGS. 2 and 3 illustrate a closed loop feedback system for controlling the tube current, and consequently the x-ray output, of the x-ray source tube. The source control circuitry includes a reference generator and compensation circuitry coupled between the reference generator and the feedback loop for adjusting the gain of the feedback loop as a decreasing function of the desired steady state tube output current value represented by the output of the reference generator. This gain compensation maintains approximately a critically damped condition in the transient response of the x-ray tube output current, notwithstanding the nonlinearity of the output current production characteristic of the tube, and the necessity for operating the tube over a range of different steady state points along its characteristic curve.

Referring now to FIGS. 2 and 3, a reference generator 12 provides a digital signal on four leads which represents a predetermined desired steady state tube output current.

This digital reference is adjustable. The digital reference signal is converted to analog form by a digital to analog converter 14. The converted analog reference value is transmitted on a lead 16 as one input to an error detector 18 which includes an operational amplifier having a common summing point. The analog reference signal and another signal representing the actual x-ray tube current output are transmitted together to the summing point 20 of the detector 18.

The output of the detector operational amplifier 18 is an analog error signal representing the difference between the reference signal, representing a predetermined desired steady state output current, and the actual output current sensed. The output of the detector 18 is transmitted to a 100 gain amplifier 22 for filtering, the output of which is in turn transmitted to amplification circuitry 24 whose gain is adjustable in a manner described in more detail below.

The output of the amplifier 24 is directed through a relay switch 26 (see FIG. 3) which is coupled to power on-off circuitry (not shown) by way of a relay driver 28 and a 18 millisecond delay relay 30. The function of the switch 26 is to prevent closure of the feedback loop for 18 milliseconds after application of high voltage to the x-ray tube. This time is required to allow the x-ray source and circuit components to acquire the anode current set by preheat control circuitry.

Once the relay switch 26 is closed after the 18 millisecond delay following power-on, the signal of the feedback loop passes through filtering circuitry 32, the purpose of which is to reduce frequency dependent gain in the circuit. The feedback signal is then converted, by square wave generation circuitry 34, to a square wave whose peak-to-peak amplitude is a function of the feedback error signal coming from the filtering circuitry 32.

The square wave is then transmitted through an isolation transformer 36 which includes two secondary coils 38, 40 (see FIG. 3). The signal appearing across the coil 40 is utilized to control preheat for the filament prior to system operation.

The secondary coil 38 preferably has 120 turns, as compared to 104 turns in the primary of the transformer 36. Thus, the square wave output appearing as a voltage across the secondary coil 38 is stepped up before being transmitted to a second isolation transformer 42.

In practice, the x-ray tube T is suitably embodied by an x-ray tube Model No. PX-400, manufactured by Dunlee Division of Picker Corporation of Chicago, Ill., U.S.A. The tube in the apparatus of the present system can be operated over a tube current output range of between approximately 5 milliamperes (ma.) and 200 ma., and has two filaments 50, 53.

After conversion to DC by a rectifier 44, the transformed and rectified square wave signal is transmitted over a set of leads 46, 48 and used to energize the x-ray tube filament 50 with direct current (DC).

Assembly 52, 54 controls the second filament 53 in the tube.

Cathode transformer 57 and control tube 59 are provided for providing main power (x-ray potential) to the x-ray tube filament.

Control of the x-ray tube filament with the DC voltage, regulated in response to the error signal from the detector, causes electrons to be emitted from the filament, or cathode, and the cathode to anode potential accelerates those electrons towards the anode, to produce a controlled amount of x-rays.

The anode current, appearing on a lead 60, is divided at a point 62. One portion of the anode current is directed through a bleeder resistor 64. The other portion going to the anode voltage source circuitry 66. A signal representing part of the anode current and control tube bias current is picked off a terminal 68 just above a precision resistor 70, and appears on a lead 72. The anode current indicating signal on the lead 74 is summed with the output of lead 72 which contains the bias current signal, but in opposite polarity from pin 68 at a summing point 76. This point is an inverting input of an operational amplifier 80. The output of the amplifier 80, representing the total anode current, is directed to the summing point 20 of the comparator detector amplifier 18 to be compared with the analog reference signal. In response to the difference between the anode current signal and the analog reference signal, the amplifier 18 produces an error signal representing the difference therebetween, which is used to regulate the filament voltage in a manner as described above.

X-ray tube output control tube 77 is also provided, in known fashion.

In order to maintain approximate critical damping in this feedback control circuit, irrespective of the point in the x-ray tubes dynamic range at which the reference signal specifies operation, circuitry is provided to adjust the gain of amplification circuitry in the feedback loop. The amplifier whose gain is adjustable is the amplifier 24, described in general above. The gain adjust circuitry, designated by reference character 82 in FIG. 2, is coupled between the reference generator 12 and the amplifier 24 to adjust the gain of the amplifier 24 as a decreasing function of the predetermined steady state value digitally indicated by the output of the reference generator 12.

The gain adjust circuitry includes a set of impedance elements (here resistors) 84, each independently connectable in the feedback loop for the amplifier 24. A binary coded digitally responsive switch 86, upon actuation, can connect any combination of the impedances 84 in the feedback loop of the amplifier 24. The determination of the selection of which of the impedances 84 are coupled in the amplifier feedback loop is made by the switching circuitry 86 in response to the value of the desired x-ray tube current, expressed digitally by a digital output of the reference generator, which produces a four-bit binary code on a set of leads 90 indicating the magnitude of the desired steady state x-ray tube anode current.

Preferably, the amplifier 24 and its associated circuitry is chosen, along with the values of the impedances 84, such that the gain of the amplifier 24 is approximately an inverse function of the value expressed by the steady state anode current value indicated by the binary signal on the leads 90. As can be seen in FIG. 3, since only a finite number of impedances 84 can be used, this inverse gain function can be approximated in only a stepwise fashion. Tests have shown, however, that such an approximation is suitable for effective operation of the current control system. As will be clear to those skilled in the art, the number of impedances, and the selection of the switch, can be made such that more or fewer impedances can be used so that the gain of the amplifier 24 can be made to correspond more closely to a continuous inverse curve with respect to the steady state anode current value indicated by the leads 90. Alternately, known means of controlling amplifier gain as a continuous function of the reference signal can be usefully employed. Such continuous control could be used where the reference signal used to control gain is analog, rather than digital.

The system of this invention, according to test results, can bring the tube current output to within ±2% of desired steady state value within 200 ms. of feedback circuit actuation.

Preferably, the gain of the amplifier 24 is controlled as an approximate inverse function of the steady state anode current value represented by the reference signal.

This detailed description of the invention is intended to be illustrative, rather than exhaustive of the invention. It should be recognized that those of ordinary skill in this field will be able to make certain additions, delections, and modifications to the specific embodiment disclosed here without departing from the substance or spirit of the invention, or its scope as defined in the appended claims.

What is claimed is:

1. A computerized tomographic medical diagnostic system comprising:

(a) an x-ray tube positioned to direct x-rays through a patient's body and power circuitry for actuating the tube;

(b) a set of detectors positioned to sense x-rays emergent from the patient's body;

(c) an information processing system coupled to the detectors for processing signals from the detectors representing detected x-ray energy and for producing therefrom a representation of internal body structure of the patient;

(d) a closed loop feedback control system for controlling the x-ray tube current output, said system comprising:

(i) a reference generator for producing a uniform reference signal representing a desired steady state controlled tube current output;

(ii) circuitry for applying the reference signal on command to actuate the tube for the production of x-rays;

(iii) means for sensing actual x-ray tube output current;

(iv) a detector for producing an error signal which is a function of the difference between the actual tube current sensed and the current represented by the reference signal;

(v) forward loop circuitry for influencing the x-ray tube current as a function of the value of the error signal, and (vi) compensation circuitry for adjusting the forward loop gain of the feedback loop circuitry as a function of the desired steady state output current represented by the value of the tube current reference signal for maintaining a substantially constant ratio between error signal variation and tube current variations.

2. Feedback control circuitry for controlling the tube current output of an x-ray tube by filament voltage adjustment, the tube being couplable to power circuitry for energizing the filament and applying tube voltage from anode to cathode, the tube also having a predictable nonlinear tube current output characteristic with respect to filament voltage, constituting a first function, said circuitry comprising:

(a) a generator for producing an adjustable reference signal representing a desired tube current for output during active production of x-rays;

(b) means for sensing actual tube current output;

(c) an error detector for producing an error signal which is a function of the difference between the sensed tube current and the current represented by the reference;

(d) a forward loop portion including an amplifier for driving filament voltage as a function of the error signal; and (e) compensation circuitry for adjusting the electronic forward loop gain of the feedback loop circuitry for maintaining as substantially a constant the gain of the entire loop comprising said sensor, error detector, forward loop portion and x-ray tube, over a range of reference signal values, in order to maintain a substantially uniform transient response of x-ray tube current output during active production of x-rays.

* * * * *